US008266868B2

(12) United States Patent
Bellamah

(10) Patent No.: US 8,266,868 B2
(45) Date of Patent: Sep. 18, 2012

(54) OPENING DEVICE FOR OUTER WRAPPING AND METHOD FOR FORMING

(75) Inventor: Stephen Bellamah, Midlothian, VA (US)

(73) Assignee: Phillip Morris USA Inc., Richmond, VA (US)

( * ) Notice: Subject to any disclaimer, the term of this patent is extended or adjusted under 35 U.S.C. 154(b) by 0 days.

(21) Appl. No.: 12/155,066

(22) Filed: May 29, 2008

(65) Prior Publication Data

US 2008/0295455 A1 Dec. 4, 2008

Related U.S. Application Data

(60) Provisional application No. 60/924,824, filed on Jun. 1, 2007.

(51) Int. Cl.
*B65B 51/04* (2006.01)

(52) U.S. Cl. ..... 53/137.2; 53/412; 383/5; 383/86; 383/207

(58) Field of Classification Search ..... 53/412, 53/137.2; 383/5, 84, 86, 87, 207
See application file for complete search history.

(56) References Cited

U.S. PATENT DOCUMENTS 3,535,409 A * 10/1970 Rohde ..... 264/514
3,625,270 A * 12/1971 Skendzic ..... 383/204
3,804,235 A 4/1974 Anderson
4,105,116 A * 8/1978 Jones et al. ..... 206/484
4,483,018 A * 11/1984 Whelan ..... 383/5
4,509,196 A * 4/1985 Sak et al. ..... 383/5
4,586,312 A 5/1986 Limousin
4,709,399 A * 11/1987 Sanders ..... 383/66
4,941,196 A * 7/1990 Edelman et al. ..... 383/5
5,172,980 A * 12/1992 Provost ..... 383/204
5,352,041 A * 10/1994 Fullerton et al. ..... 383/5
5,606,846 A * 3/1997 Raby et al. ..... 53/415
5,613,779 A * 3/1997 Niwa ..... 383/201
5,631,068 A * 5/1997 Smith ..... 428/195.1
5,772,330 A * 6/1998 Bang et al. ..... 383/87
5,775,812 A 7/1998 St. Phillips et al.
5,954,431 A * 9/1999 Fabel ..... 383/5
5,996,784 A 12/1999 Thoeren et al.
6,286,999 B1 9/2001 Cappel et al.
6,342,258 B1 * 1/2002 Berings et al. ..... 426/79
6,439,770 B2 8/2002 Catchman
6,447,015 B1 * 9/2002 Linnewiel ..... 283/81
6,575,625 B2 6/2003 Cappel et al.
6,663,283 B1 12/2003 Cappel
6,817,764 B2 * 11/2004 O'Rourke et al. ..... 383/84
7,008,106 B2 3/2006 Cappel
2002/0152723 A1 * 10/2002 Ausnit ..... 53/412
2003/0081865 A1 * 5/2003 Baker et al. ..... 383/204
2003/0133630 A1 * 7/2003 Wang ..... 383/5
2005/0072437 A1 * 4/2005 Gomez ..... 131/329

(Continued)

*Primary Examiner* — Thanh Truong
(74) *Attorney, Agent, or Firm* — Buchanan Ingersoll & Rooney PC

(57) ABSTRACT

Provided is a tamper proof outer wrapping with a reinforced tear zone. The reinforced tear zone includes a tear tape affixed between two layers of the wrapping material. A perforated line runs parallel to the reinforced tear zone on each of the reinforced tear zone. A tab is formed at one end of the reinforced tear zone. The tab is pulled to separate the reinforced tear zone from the remaining wrapping material and open remove the outer wrapping. The wrapping can be used on packages containing smoking articles such as cigarettes or orally consumed products such as candy or pouched tobacco products.

13 Claims, 2 Drawing Sheets

U.S. PATENT DOCUMENTS

2005/0199686 A1 9/2005 Nowak et al.
2005/0226542 A1* 10/2005 Kendall et al. ..... 383/207
2005/0269220 A1 12/2005 Focke et al.
2005/0284775 A1 12/2005 McLaughlin et al.
2006/0054670 A1 3/2006 Focke et al.
2006/0133700 A1 6/2006 Cappel

* cited by examiner

OPENING DEVICE FOR OUTER WRAPPING AND METHOD FOR FORMING

CROSS REFERENCE TO RELATED APPLICATION

This application claims priority under 35 U.S.C. §119(e) to U.S. provisional Application No. 60/924,824, filed on Jun. 1, 2007, the entire content of which is incorporated herein by reference.

BACKGROUND

Generally, tamper proof outer wrappers are provided with a tear tape or perforated area that can be pulled to remove the plastic wrapper from the inner package or product. Often such opening methods tear the plastic wrap resulting in only a partially unwrapped package.

Thus, there is a need for a reinforced opening device for a tamper proof outer wrapper.

SUMMARY

As provided herein, a tamper proof outer wrapping for a product package includes a reinforced tear zone for easily opening the outer wrapping.

Preferably, the reinforced tear zone includes at least two layers of a wrapping material, and a tear tape affixed between the layers. Also preferably, the layers of wrapping material are sealed around the inner tear tape.

In an embodiment, the tear tape is affixed between a first edge and a second edge of a piece of wrapping material such that the piece of wrapping material forms a tube. In another embodiment, the tear tape is affixed between two separate pieces of wrapping material.

Preferably, positioning the tear tape between multiple layers of the wrapping material strengthens the reinforced tear zone so that the tear zone does not break when pulled to remove the wrapper from around the package or product.

In a preferred embodiment, at least one cut is made at an angle to the perforated portion at the top or bottom of the wrapping material so that a tab is created adjacent to the reinforced tear zone. The cut is made so that it angles down from the edge of the wrapping material to the perforated portion.

Preferably, the tab is pulled to engage the reinforced tear zone. In addition, the angled cuts reduce the amount of point created during the shrinking process when the reinforced tear zone is used on shrink wrap packaging.

In an embodiment, perforated portions extend along each side of and run substantially parallel to the reinforced tear tape portion. When the tear zone is pulled by the tab, the tear zone pulls away from the remaining wrapper material along the perforated portions.

Preferably, the wrapping material has indicia printed thereon. In an embodiment, the indicia include lettering or graphics.

In a preferred embodiment, the wrapping material is a plastic. Preferably, the plastic is a shrink wrap. However, in other embodiments, the wrapping material is paper or metal, such as metalized film, metal foil, or other metallic material.

Also provided is a method of forming a tamper proof outer wrapping having a reinforced tear zone. The method includes obtaining a wrapping material and printing indicia on the wrapping material. Preferably, two parallel perforated portions are formed in the film, one near each edge. In an embodiment, a tear tape is affixed to one edge of the wrapping material, running parallel to the perforated portions so that the tear tape is between the edge of the material and the nearest perforated portion. Preferably, the opposing edge is pulled around and sealed over the tear tape so that the tear tape runs between the two perforated portions to form a tube. In a preferred embodiment, angled cuts are made on either side of the reinforced tear zone in the tube. In an embodiment, the tube is cut, a package is positioned within the tube, and heat is applied to shrink the wrapping material around the package.

DETAILED DESCRIPTION OF THE DRAWINGS

DETAILED DESCRIPTION

Figure 1:
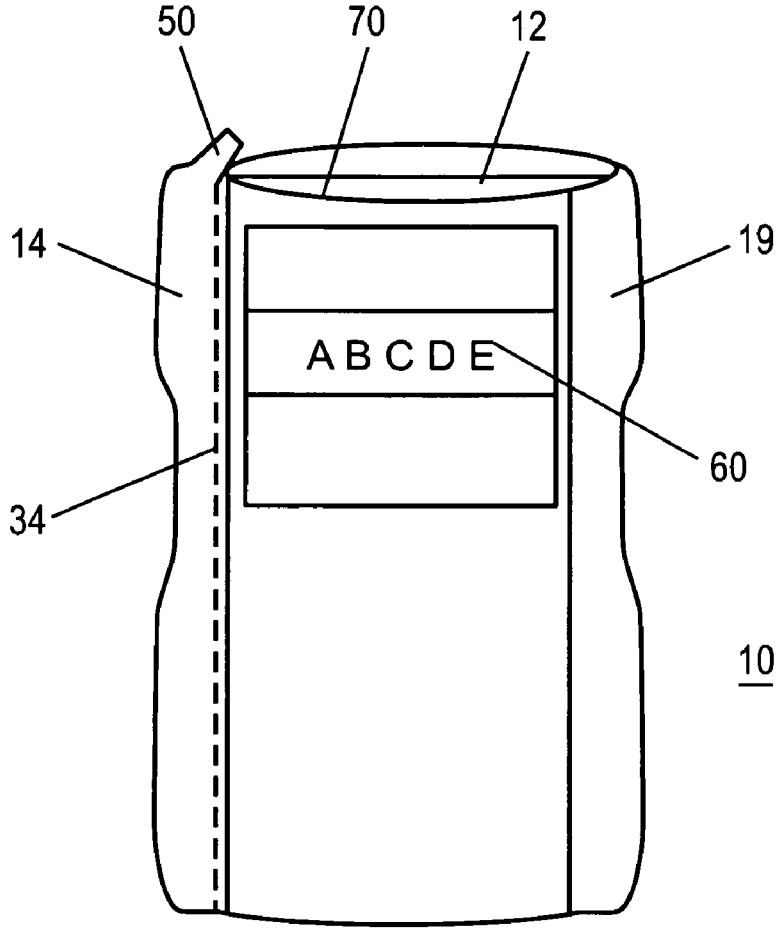
FIG. 1 is an illustration of a package covered with a tamper proof outer wrapping having a reinforced tear zone.

As shown in FIG. 1, provided is a tamper proof outer wrapping 10 for a product package 12. The outer wrapping 10 includes a reinforced tear zone 14 for opening the outer wrapping 10. Preferably, the reinforced tear zone 14 has a tab 50 that is grasped to pull the reinforced tear zone 14. The reinforced tear zone 14 pulls away from the remaining portion of the outer wrapping 10 at the perforation portions 34. In an embodiment, because the tear zone 14 is reinforced, the tear zone 14 does not break off as it is pulled, thereby providing easy access to the contents of the wrapper 10.

In a preferred embodiment, the wrapping material 19 is a plastic. Preferably, the plastic is a shrink wrap. In an embodiment, the shrink wrap is selected from the group consisting of Pet-G, PVC, polypropylene, polyethylene, polyolefin, polylactide and combinations thereof.

In other embodiments, the wrapping material 19 may also be formed with paper or metal, such as metalized film, metal foil, or other metallic material.

In a preferred embodiment, the wrapping material 19 is clear. In another embodiment, the wrapping material 19 is opaque. In other embodiments, the wrapping material 19 is colored or scented.

Preferably, the outer wrapping 10 is used as an outer wrapping for pocket-sized containers that enclose tobacco or non-tobacco products such as cigarettes, pouched tobacco products, pouched non-tobacco products, and the like.

In other embodiments, the outer wrapping 10 is used to enclose containers for gums, mints, and other edible products that require tamper resistant features. Preferably, the outer wrapping 10 covers the opening device of the inner packaging so that the enclosed product cannot be accessed without first removing the outer wrapping 10.

Figure 2:
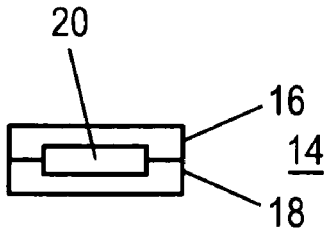
FIG. 2 is a cross-sectional view of an embodiment of a reinforced tear zone.

As seen in FIG. 2, preferably, the reinforced tear zone 14 includes at least two layers 16, 18 of a wrapping material 19, and a tear tape 20 affixed between the layers 16, 18. Also preferably, the layers 16, 18 of wrapping material 19 are sealed around the inner tear tape 20. In an embodiment, the layers 16, 18 are glued together. In another embodiment, the layers 16, 18 are heat sealed together.

Figure 3:
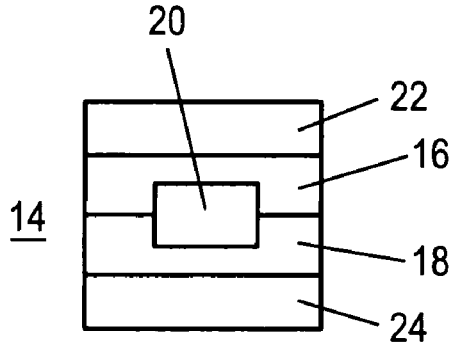
FIG. 3 is a cross-sectional view of another embodiment of a reinforced tear zone.

In an embodiment, as seen in FIG. 3, additional layers 22, 24 of wrapping material 19 may surround the tear tape 20 and the layers 16, 18 of wrapping material 19. In an embodiment, an equal number of layers of the wrapping material 19 surround the tear tape 20.

Figure 6:
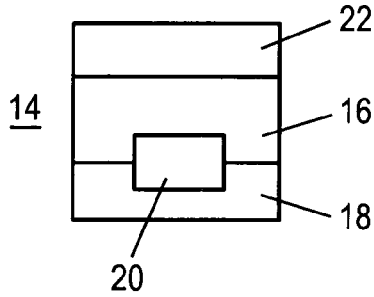
FIG. 6 is a cross-sectional view of another embodiment of a reinforced tear zone.

As seen in FIG. 6, in another embodiment, an unequal number of layers of wrapping material 19 surround the tear tape 20 in the reinforced tear zone 14.

Figure 4:
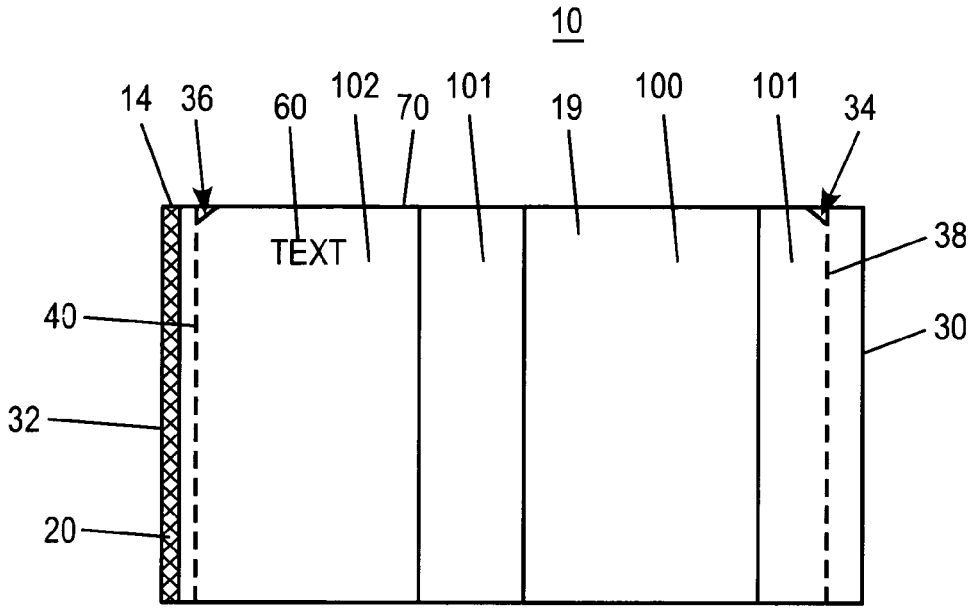
FIG. 4 is an illustration of the wrapping material prior to being installed on a package.

In a preferred embodiment, as seen in FIG. 4, the tear tape 20 is affixed to a first edge 32 of the outer wrapper 10. A second edge 30 of the outer wrapper 10 is folded over the first edge 32 and the tear tape 20 to create a tube with a reinforced tear zone 14 that can be placed over a product package.

In another embodiment, the tear tape 20 is affixed between two separate pieces of wrapping material 19.

Positioning the tear tape 20 between multiple layers of the wrapping material strengthens the reinforced tear zone so that the tear zone does not break when pulled to remove the wrapper from around the package or product.

Figure 5:
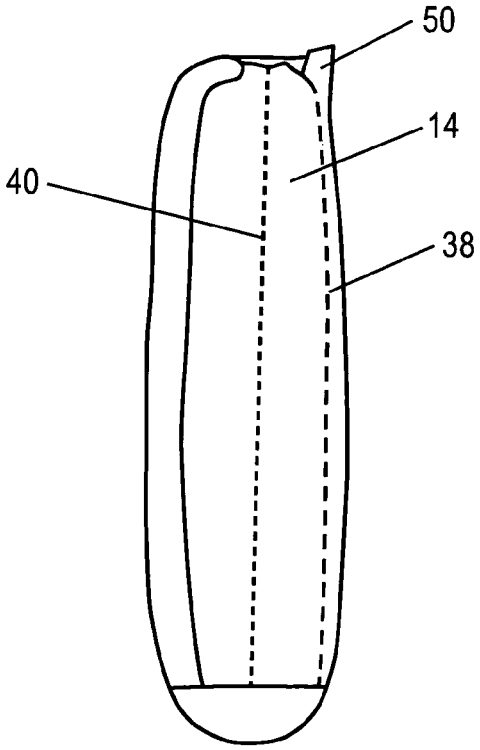
FIG. 5 is a side view of a package covered with a tamper proof outer wrapping having a reinforced tear zone.

As shown in FIG. 5, in an embodiment, perforated portions 38, 40 extend longitudinally along the wrapping material 19, Also preferably, the perforated portions 38, 40 run along each side of and substantially parallel to the reinforced tear zone 14. Preferably, the perforated portions 38, 40 are parallel to one another. Also preferably, the perforated portions 38, 40 are each a substantially straight line.

In an embodiment, the perforated portions 38, 40 are created prior to forming the reinforced tear zone 14. Preferably, the perforated portions 38, 40 are formed at a distance from the edge of the wrapping material 19 to leave space for the reinforced tear zone 14 to be formed between the perforated portion 40 and the edge 32. Preferably, when the reinforced tear zone 14 is formed, the edges 30, 32 can overlap and be sealed together so that the reinforced tear zone 14 lies between the perforated portions 38, 40.

In a preferred embodiment, at least one angled cut 34, 36, as seen in FIG. 4, is made adjacent to the at least one perforated portion 38, 40. Preferably, the cuts 34, 36 are made at an angle of about 200 to about 1600 with respect to the perforated portions 38, 40. More preferably, the cuts are made at an angle of about 40° to about 140°. In a preferred embodiment, the cuts are made at an angle of about 450 with respect to the perforated portions 38, 40. Preferably, the cuts 34, 36 angle down from the top 70 of the wrapping material 19 to the perforated portion 38, 40. In an embodiment, the cuts are made at the bottom of the wrapping material.

The cuts 34, 36 form a tab 50, as shown in FIG. 1 and FIG. 5. Preferably, the tab 50 is created adjacent to the reinforced tear tape zone 14.

Preferably, the tab 50 is pulled to engage the reinforced tear zone 14. When the tear zone 14 is pulled by the tab 50, the tear zone 14 pulls away from the remaining wrapper material 19 along the perforated portions 38, 40.

In addition, the angled cuts 34, 36 reduce the amount of "point" created during the shrinking process when the reinforced tear zone is used on shrink wrap packaging.

Preferably, as shown in FIG. 1, the wrapping material 19 has indicia 60 printed thereon. The indicia 60 includes lettering, graphics, and the like. Preferably, the indicia 60 is printed on the wrapping material 19 prior to the formation of the outer wrapping 10. In an embodiment, the indicia 60 is printed on the wrapping material 19 prior to the addition of the perforated portions 38, 40. The indicia 60 can be printed on the front 100, sides 101 or the back 102 of the wrapping material 19.

Also provided is a method of forming a tamper proof outer wrapping having a reinforced tear zone. The method includes obtaining a wrapping material and printing indicia thereon. In an embodiment, at least two perforated portions are formed in the wrapping material near opposing edges.

In a preferred embodiment, a tear tape is affixed to a first layer of wrapping material so that the tear tape runs parallel to both the edge of the first layer and a perforated portion.

The method also includes sealing a second layer of wrapping material over the first portion having the tear tape affixed thereto to create a reinforced tear zone flanked by each of the perforated portions.

In an embodiment, the reinforced tear zone and wrapping material are formed with one piece of wrapping material so that once the reinforced tear zone is formed, the wrapping material is in the form of a tube.

In an embodiment, the tube is cut into portions sized to fit the product to be covered, and angled nick cuts are made adjacent to each perforated portion. The product is then inserted into the tube. If the wrapping material is a shrink wrap, then the wrapped product is placed in a heater to shrink the material around the product package.

In use, the consumer grabs the tab 50, shown in FIGS. 1 and 5, and pulls. The tab 50 engages the reinforced tear zone 14, so that when pulled the reinforced tear zone 14 tears away from the remaining wrapping material 19 at the perforated portions 38, 40.

While the foregoing has been described in detail with reference to specific embodiments thereof, it will be apparent to one skilled in the art that various changes and modifications may be made, and equivalents thereof employed, without departing from the scope of the claims.

I claim:

1. A tamper proof outer wrapping for a product package comprising:

an outer wrapper of wrapping material in the form of a tube having a length shorter than a length of a product package around which the outer wrapper is wrapped, the outer wrapper having a first side edge, a second side edge, a top edge, a bottom edge and a reinforced tear zone, said reinforced tear zone including at least two layers of overlapping portions of said wrapping material; and a tear tape affixed between said at least two layers, wherein said at least two layers are sealed together surrounding said tear tape, and wherein said reinforced tear zone is affixed to said first side edge of the outer wrapper; and wherein said outer wrapper includes a first perforated portion and a second perforated portion, each of said first and second perforated portions extending along opposing sides of and running substantially parallel to said reinforced tear zone, and wherein said outer wrapper includes at least one angled cut made at about a 20° to about a 160° angle from said top and/or bottom edge of the outer wrapper to at least one of the first and second perforated portions so that a tab is created adjacent to said reinforced tear zone, and wherein the top edge and the bottom edge are free ends.

2. The tamper proof outer wrapping of claim 1, wherein said wrapping material is a plastic.

3. The tamper proof outer wrapping of claim 2, wherein said plastic is a shrink wrap.

4. The tamper proof outer wrapping of claim 3, wherein said shrink wrap is selected from the group consisting of Pet-G, PVC, polypropylene, polyethylene, polyolefin, polylactide and combinations thereof.

5. The tamper proof outer wrapping of claim 1, wherein said tab is pulled to engage the reinforced tear zone.

6. The tamper proof outer wrapping of claim 1, wherein said wrapping material has indicia printed thereon.

7. The tamper proof outer wrapping of claim 1, wherein said tear tape affixed between the at least two overlapping portions of wrapping material strengthens the reinforced tear zone.

8. The tamper proof outer wrapping of claim 1, wherein said wrapping material is colored.

9. The tamper proof outer wrapping of claim 1, wherein said wrapping material is clear.

10. The tamper proof outer wrapping of claim 1, wherein said wrapping material is opaque.

11. The tamper proof outer wrapping of claim 1, wherein said wrapping material is scented.

12. The tamper proof outer wrapping of claim 1, wherein said reinforced tear zone includes multiple layers of said wrapping material sealed on each side of said tear tape.

13. A tamper proof outer wrapping for a product package comprising:

an outer wrapper of wrapping material in the form of a tube having a length shorter than a length of a product package around which the outer wrapper is wrapped, the outer wrapper having a first side edge, a second side edge, a top edge, a bottom edge and a reinforced tear zone, said reinforced tear zone including at least two layers of overlapping portions of said wrapping material; and a tear tape affixed between said at least two layers, wherein said at least two layers are sealed together surrounding said tear tape, and wherein said reinforced tear zone is affixed to said first side edge of the outer wrapper;

wherein said outer wrapper includes a first perforated portion and a second perforated portion, each of said first and second perforated portions extending along opposing sides of and running substantially parallel to said reinforced tear zone, wherein said outer wrapper includes at least one angled cut made at about a 20° to about a 160° angle from said top and/or bottom edge of the outer wrapper to at least one of the first and second perforated portions so that a tab is created adjacent to said reinforced tear zone, wherein the top edge and the bottom edge are free ends, and wherein said wrapping material is a shrink wrap.

* * * * *